US011406153B2

(12) United States Patent
Kim

(10) Patent No.: US 11,406,153 B2
(45) Date of Patent: Aug. 9, 2022

(54) SWEAT-ABSORBING PAD FOR USE WITH HEADWEAR

(71) Applicant: William Kim, Vernon, CA (US)

(72) Inventor: William Kim, Vernon, CA (US)

( * ) Notice: Subject to any disclaimer, the term of this patent is extended or adjusted under 35 U.S.C. 154(b) by 0 days.

(21) Appl. No.: 17/094,713

(22) Filed: Nov. 10, 2020

(65) Prior Publication Data

US 2022/0142288 A1 May 12, 2022

(51) Int. Cl.
*A42C 5/02* (2006.01)
*A42B 1/24* (2021.01)

(52) U.S. Cl.
CPC . *A42C 5/02* (2013.01); *A42B 1/24* (2013.01)

(58) Field of Classification Search
CPC .. A42C 5/02; A42B 1/248; A42B 1/24; A42B 1/002; A42B 1/0189; A42B 1/0187; A42B 3/127; A42B 7/00; A42B 1/008; A42B 1/205; A41D 27/12; A41D 27/13; A41D 27/14; A41D 27/16; Y10T 24/13; Y10T 24/1312; Y10T 24/44; Y10T 24/44641; A44B 6/00; A44B 9/00
USPC ..... 2/181–181.6, 182.2, 182.3, 182.6, 183, 2/53, 56, 60, 63; 24/3.1, 7
See application file for complete search history.

(56) References Cited

U.S. PATENT DOCUMENTS 831,444 A * 9/1906 King ..... A42C 5/02 2/181
900,330 A * 10/1908 Wagenet ..... A42C 5/02 2/181
938,008 A * 10/1909 Marshman ..... A42C 5/02 2/181
1,421,139 A * 6/1922 Anderson ..... A42C 5/02 2/181
1,559,917 A * 11/1925 Schnebel ..... A42C 5/02 2/182.6
2,153,611 A * 4/1939 Cavanagh ..... A42C 5/02 40/329
2,801,453 A * 8/1957 Melvin ..... B65B 67/02 24/570
2,818,574 A * 1/1958 Burnison ..... A42C 5/04 2/181.2

(Continued)

FOREIGN PATENT DOCUMENTS

GB 22747 A * 7/1912
GB 191122747 A * 7/1912 ..... A42C 5/02

(Continued)

*Primary Examiner* — Amy Vanatta
(74) *Attorney, Agent, or Firm* — Heedong Chae; Lucem, PC

(57) ABSTRACT

A sweat-absorbing pad for use with a headwear having a sweatband, which includes a body with a front surface that is configured to contact, at least in part, a user's head or forehead to absorb sweat; and a first clip. The first clip includes a clip body which includes a base, first and second legs, and a clip arm. The first and second legs extend from the base, and the clip arm extends from the base. The clip arm is substantially parallel to the first and second legs, and the clip arm is resilient to bias against the clip body. The clip body is substantially received in the body. Furthermore, the first clip, configured to receive at least a portion of the sweatband, fitted in between the body and the clip arm, such that the sweat-absorbing pad is detachably fixed to the sweatband.

20 Claims, 13 Drawing Sheets

(56) References Cited

U.S. PATENT DOCUMENTS

| | | | | |
|---|---|---|---|---|
| 6,481,060 | B1 * | 11/2002 | Tsai | A42B 1/24 24/3.12 |
| 6,578,759 | B1 * | 6/2003 | Ortiz | B65D 5/6614 229/125 |
| 8,393,014 | B1 * | 3/2013 | Follo | A42C 5/02 2/181 |
| 2008/0110472 | A1 * | 5/2008 | Kaweblum | A41G 5/0026 132/276 |
| 2009/0241240 | A1 * | 10/2009 | Han | A42C 5/04 2/182.8 |
| 2016/0255897 | A1 * | 9/2016 | Johnson | A42B 3/127 |
| 2019/0313727 | A1 * | 10/2019 | Acosta | A42B 1/24 |

FOREIGN PATENT DOCUMENTS

| | | | | |
|---|---|---|---|---|
| GB | 6180 | A * | 3/1916 | |
| GB | 191506180 | A * | 3/1916 | A42C 5/02 |

* cited by examiner

SWEAT-ABSORBING PAD FOR USE WITH HEADWEAR

FIELD OF THE INVENTION

The present invention relates to a sweat-absorbing pad, and more particularly, a sweat-absorbing pad for use with a headwear having a sweatband to be worn on the head.

BACKGROUND OF THE INVENTION

Headwear such as hats, caps, helmets, and the like are popular items worn by many different individuals all over the world for various purposes. Helmets, for example, may be manufactured to protect the wearers' heads from falling objects when worn at construction sites. Alternatively, in sport, helmets may be constructed to protect the wearer's heads from objects thrown or hit at velocity, or from collisions with other players. For outdoor activities, hats and caps help shield and protect wearers' eyes from the glare and damaging effects of the sun. Whether working at a construction site, playing a sport, or simply outside to enjoy a walk, intense or long-durations of such activities in warm or hot weather will cause the user to sweat.

However, oftentimes hats, caps, and the like include materials that are thin and the amount of sweat produced by the wearer may overcome the ability of such materials to retain and hold such sweat therein. Additionally, this sweat may cause the materials to become dirty from the sweat (and natural oils caught up in the sweat) of the wearer, which may lead to the development of foul odor emanating from the caps, hats, and the like. Furthermore, the relative lack of moisture absorption and retaining ability of the materials may lead to sweat to dribble down onto the wearer's face eventually. While an annoyance for some, for others this annoyance may present a dangerous situation (e.g. sweat getting caught in the eyes of a worker at a construction site, playing heavy-contact sports, working with heavy machinery outdoors on a farm, or simply crossing the road with vehicle traffic). Therefore, there needs to be a device where sweat can be captured and stored in excess of what the headwear may or may not provide (many helmets have no materials to absorb moisture whatsoever).

Therefore, to solve the above problems, various embodiments of a sweat-absorbing pad for use with a headwear having a sweatband are provided, as there is a need for a device that accomplishes this goal. This invention is directed to solve these problems and satisfy the long-felt need.

SUMMARY OF THE INVENTION

The present invention contrives to solve the disadvantages of the prior art. The present invention provides a sweat-absorbing pad for use with a headwear having a sweatband.

The object of the invention is to provide a sweat-absorbing pad for use with a headwear having a sweatband, the sweat-absorbing pad including a body wherein a front surface thereof is configured to contact, at least in part, a user's head or forehead for absorbing sweat; and a first clip. The first clip includes a clip body which includes a base, a first leg and a second leg wherein the first and second legs extend from the base; and a clip arm which extends from the base wherein the clip arm is substantially parallel to the first and second legs. The clip arm is resilient to bias against the clip body. The clip body is substantially received in the body. Furthermore, the first clip is configured to receive at least a portion of the sweatband fits in between the body and the clip arm in order for the sweat-absorbing pad to be detachably fixed to the sweatband.

Another object of the invention is to provide a headwear having a sweat-absorbing pad, including a sweat-absorbing pad having a first recess wherein a first hook-and-loop fastener is received in the first recess of the sweat-absorbing pad and attached to the sweat-absorbing pad; and a sweatband having a first coupling recess wherein a first coupling hook-and-loop fastener is received in the first recess of the sweatband and sewn or attached to the sweatband. The first hook-and-loop fastener is configured to be detachably fastened to the first coupling hook-and-loop fastener.

Yet another object of the invention is to provide a sweat-absorbing pad for use with a headwear having a sweatband, the sweat-absorbing pad includes a body which includes an absorbent layer and an impervious layer; and an attachment means configured such that the sweat-absorbing pad is detachably fixed to the sweatband. The absorbent layer is constructed to absorb sweat from a user's head or forehead, and the impervious layer is constructed to block the sweat from passing through to the sweatband or the headwear.

The advantages of the present invention are: (1) provide a small sweat-absorbing pad that can be easily detachably coupled to headwear commonly found today; (2) the sweatband of the headwear can be kept relatively clean, as sweat from the wearer, and natural oils caught up in the sweat, are absorbed in the sweat-absorbing pad rather than in the sweatband; (3) the sweat-absorbing pad is easily carried and transported from one location to another; (4) the sweat-absorbing pad can easily be decoupled from the headwear, which allows the user to conveniently swap the sweat-absorbing pad if needed; (5) less headwear will be dirtied by sweat and oils of the wearer, which leads to less waste of headwear being thrown away simply due to their dirtiness, and possibly foul odor; and (6) the sweat-absorbing pad can easily be coupled and decoupled to and from sweatbands and other headwear features for a large variety of different types of headwear.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
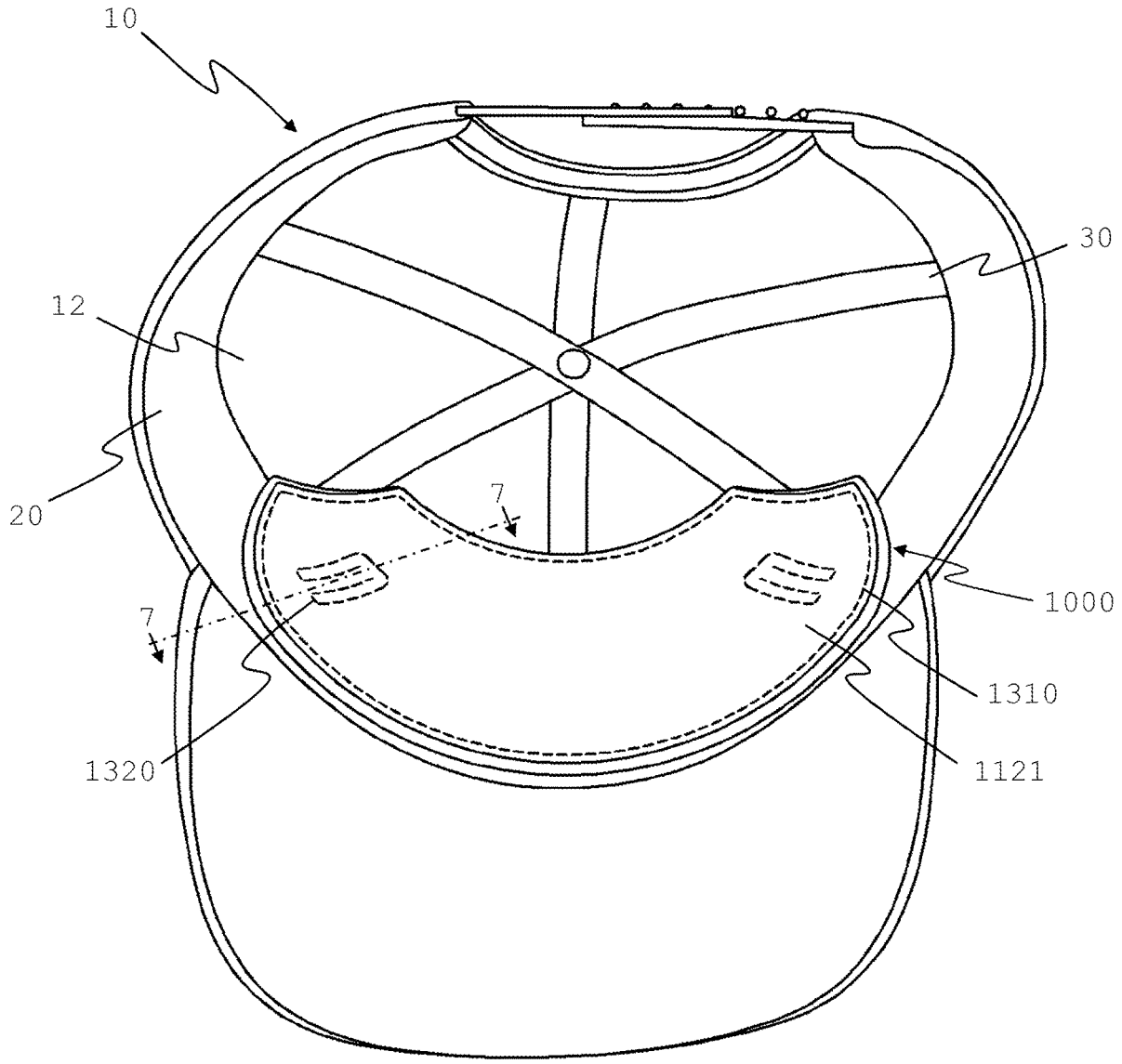
FIG. 1 shows a bottom perspective view of a sweat-absorbing pad according to embodiments of the present invention.
Figure 2:
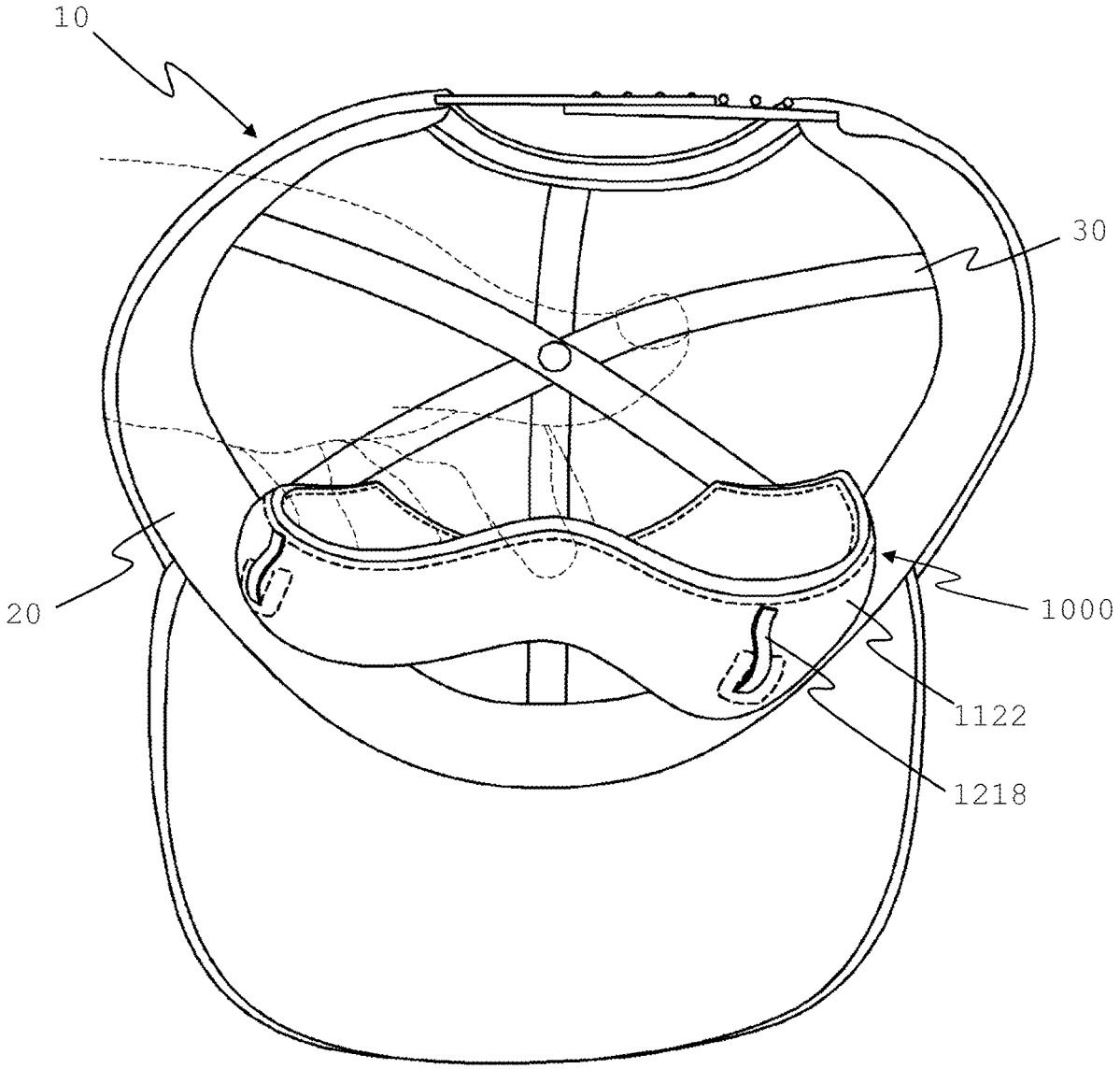
FIG. 2 shows a bottom perspective view of a sweat-absorbing pad according to embodiments of the present invention.
Figure 3:
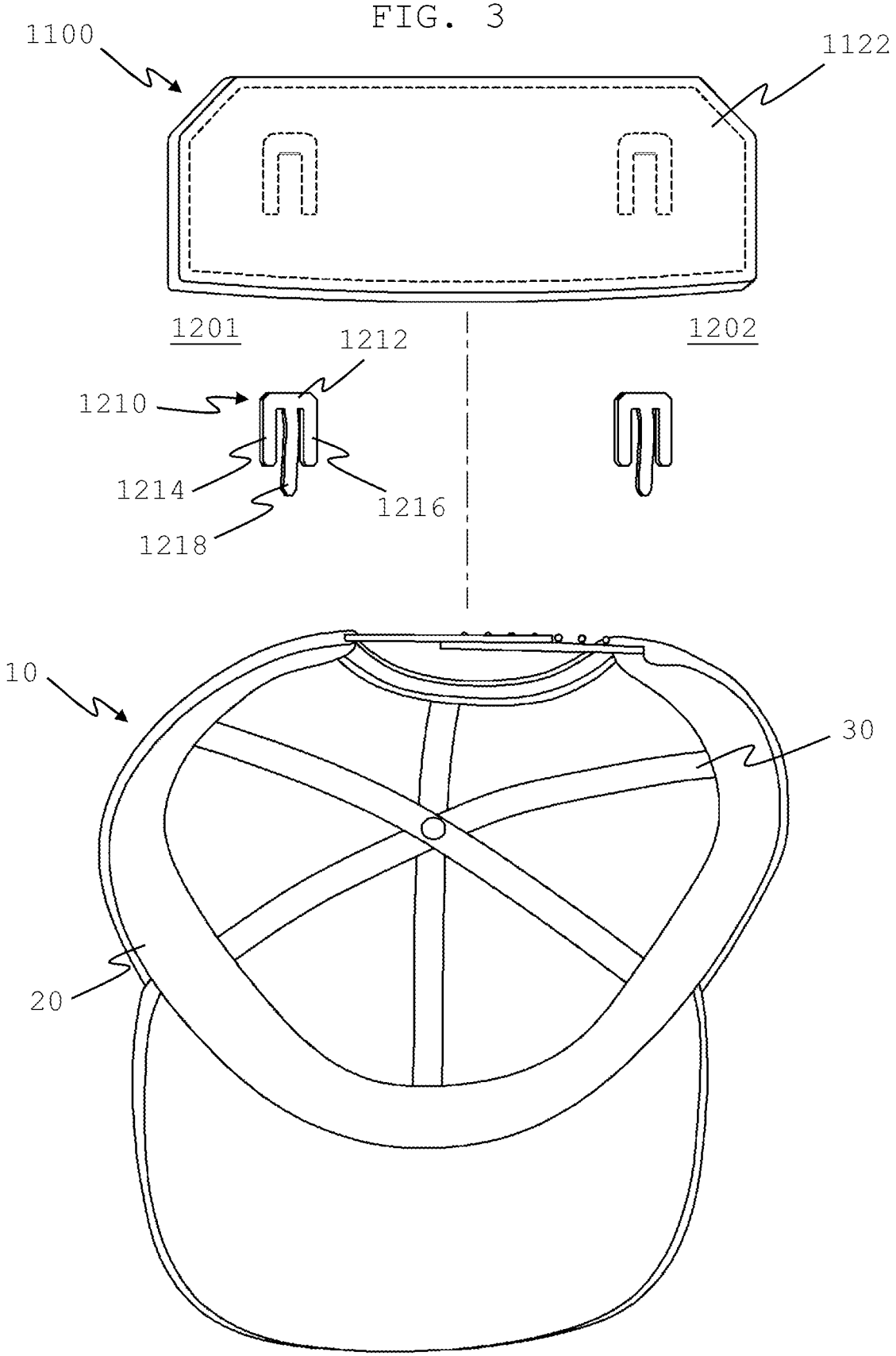
FIG. 3 shows an exploded view of a sweat-absorbing pad according to embodiments of the present invention.
Figure 4A:
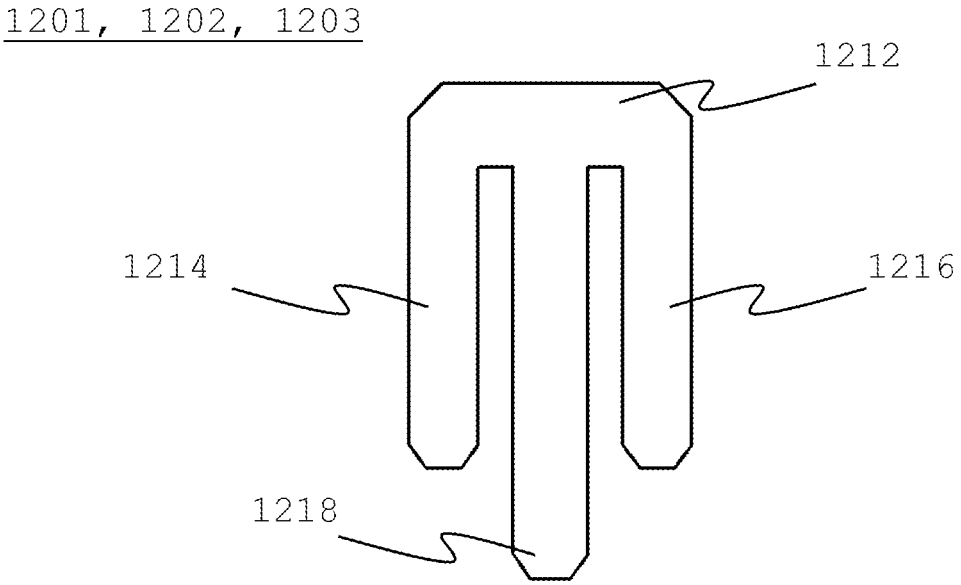
FIG. 4A shows front plan view and FIG. 4B shows a right side view of a clip according to embodiments of the present invention.

FIGS. 1-3 show a sweat-absorbing pad (1000) for use with a headwear (10) having a sweatband (20). The sweat-absorbing pad (1000) includes a body (1100) wherein a front surface thereof is configured to contact, at least in part, a user's head or forehead for absorbing sweat; and a first clip (1201). As shown in FIGS. 3 and 4A, the first clip (1201) includes a clip body (1210) which includes a base (1212), a first leg (1214) and a second leg (1216) wherein the first and second legs (1214, 1216) extend from the base (1212); and a clip arm (1218) which extends from the base (1212). As shown in FIG. 4A, the direction of the extension of the clip arm (1218) is substantially parallel to the first and second legs (1214, 1216). Additionally, the clip arm (1218) is resilient in its construction to bias against the clip body (1210). As shown in FIG. 2, the clip body (1210) is substantially received in the body (1100). The first clip (1201) is configured to receive at least a portion of the sweatband (20) that fits in between the body (1100) and the clip arm (1218) in order for the sweat-absorbing pad (1000) to be detachably fixed to the sweatband (20) as shown in FIG. 2.

As shown in FIG. 4A, the clip arm (1218) is positioned between the first leg (1214) and the second leg (1216). Also shown, the first leg (1214) and the second leg (1216) extend from both ends of the base (1212) and the clip arm (1218) extends from about a middle of the base (1212). Furthermore, clip arm (1218) extends beyond the first leg (1214) and the second leg (1216).

Figure 4B:
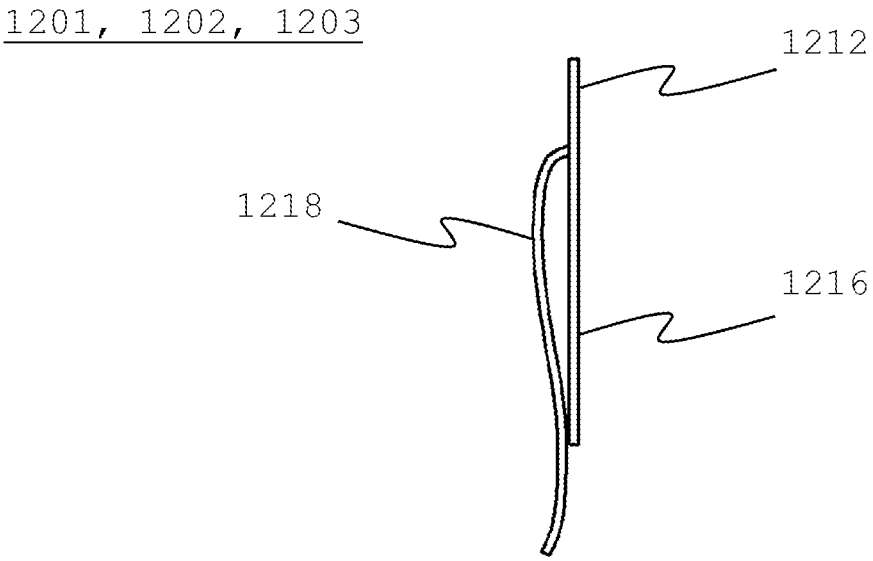

As shown in FIG. 4B, the clip arm (1218) may be constructed to bend upwardly from the first and second legs (1214, 1216) and then downwardly toward the first and second legs (1214, 1216). More specifically, an end of the clip arm (1218) bends upwardly from the first and second legs (1214, 1216) for easy insertion of the sweatband (20) in between the clip arm (1218) and the body (1100). This construction provides the clip arm (1218) the flexibility to accept the sweatband (20) of the headwear (10) while the resilient properties of the clip arm (1218) allow the clip arm (1218) to retain the sweatband (20).

Figure 5A:
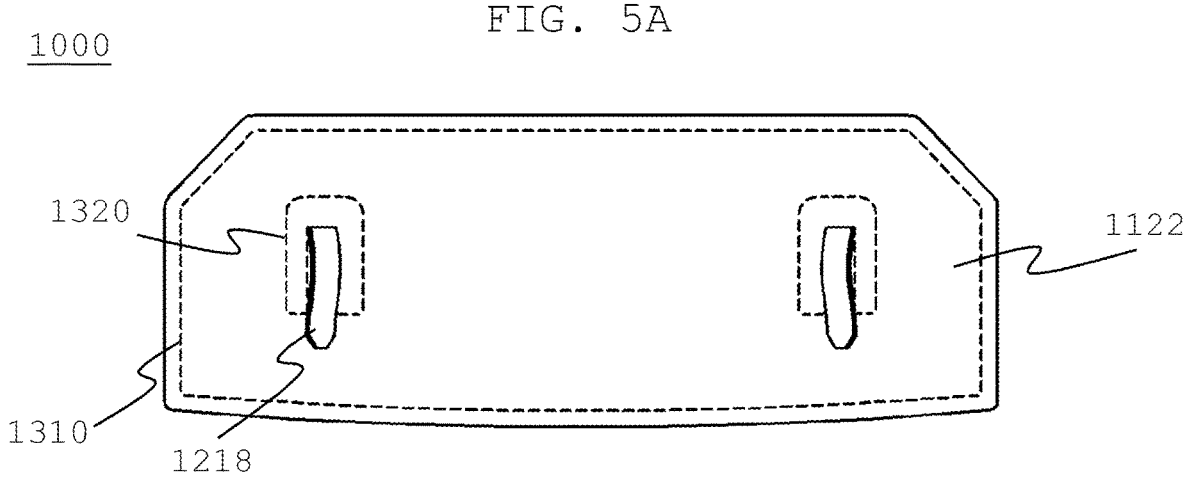
FIGS. 5A-C show views of a sweat-absorbing pad according to embodiments of the present invention.
Figure 5B:
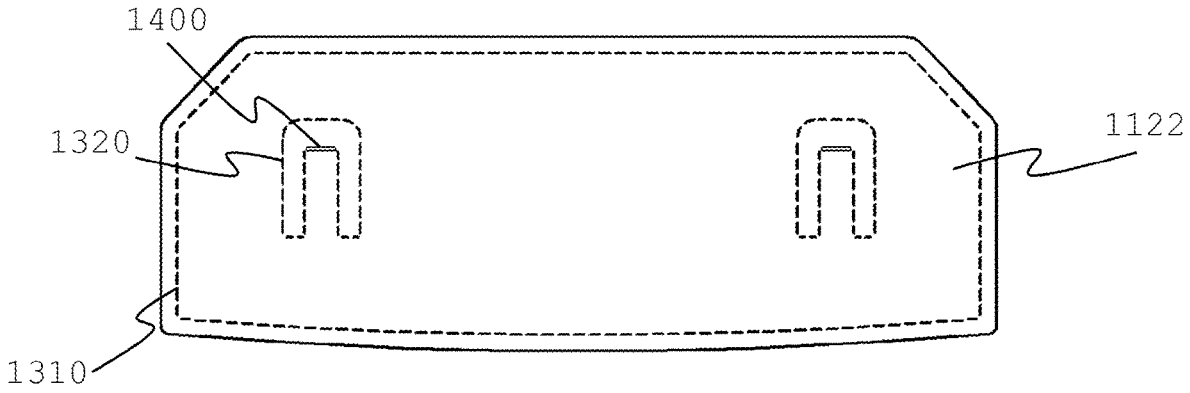
Figure 5C:
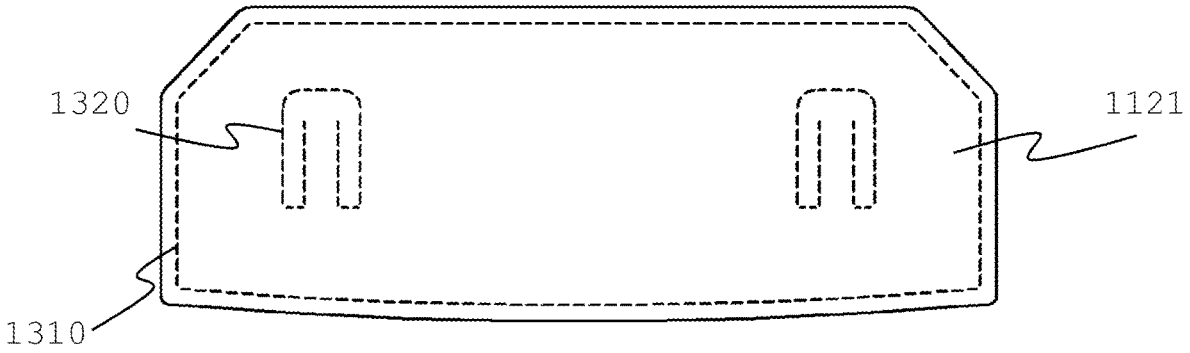
Figure 6A:
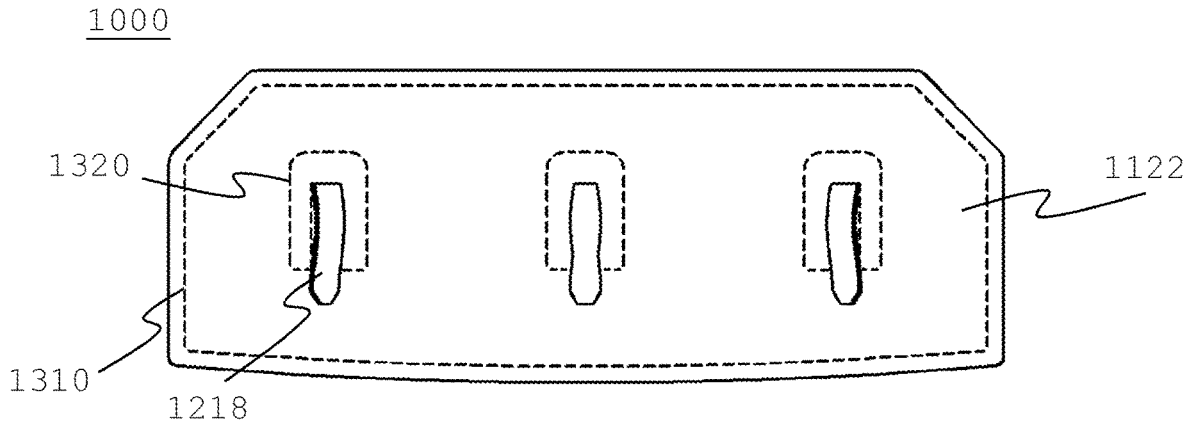
FIGS. 6A-C show views of a sweat-absorbing pad according to embodiments of the present invention.
Figure 6B:
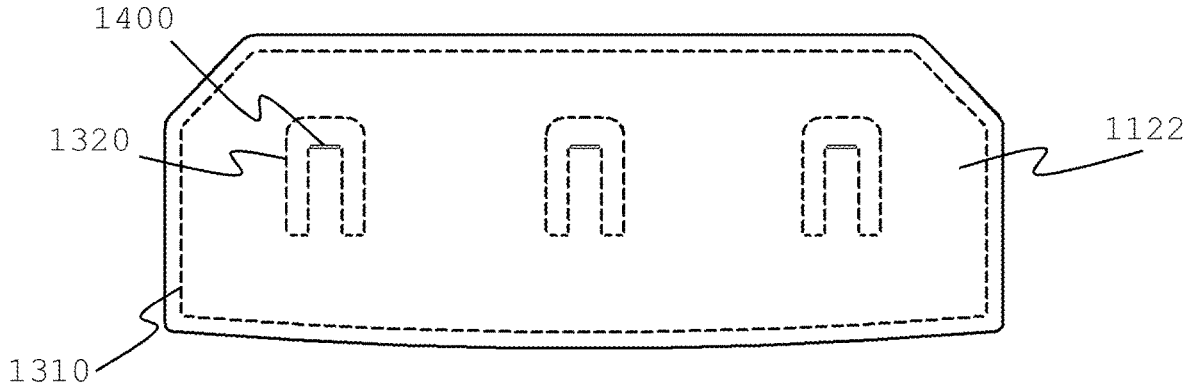

The clip body (1210) is substantially received in the body (1100) by stitches (1320) that substantially surround the clip body (1210) as shown in FIGS. 5A and 6A. FIGS. 5B and 6B show a slit (1400) formed on the body (1100) such that the clip arm (1218) extends from the clip body (1210) out of the slit (1400) as shown in FIGS. 5A and 6A. The stitches (1320) may also continue atop and across the slit (1400) such that the stitches (1320) traverse across the clip arm (1218), or across about the portion of the clip arm (1218) extending from the base (1212). The stitches (1320) traversing the slit (1400) and the clip arm (1218) provide added durability against the effects of wear and tear experienced by the clip arm (1218) after repeated long-term use of the sweat-absorbing pad (1000) with a headwear (10) having a sweatband (20) (e.g. caps, hats, and the like) or headband (e.g. construction helmets).

As shown in FIGS. 3 and 5A-C, The sweat-absorbing pad (1000) may further include a second clip (1202) having a structure that is substantially the same as a structure of the first clip (1201). As shown, the body (1100) is symmetrical with respect to a middle line. Additionally, the first clip (1201) and the second clip (1202) are symmetrically positioned with respect to the middle line.

Figure 6C:
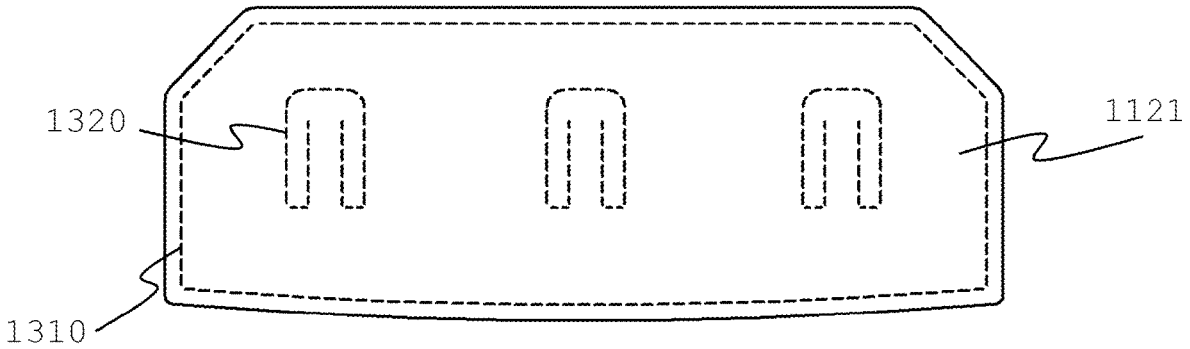

As shown in FIGS. 6A-C, the sweat-absorbing pad (1000) may further include a third clip (1203) having a structure that is substantially the same as the structure of the first clip (1201). As shown, the third clip (1203) is substantially positioned in the middle line. The presence of the third clip (1203) provides an additional clip to hold onto the sweatband (20) of the headwear (10) for the sweat-absorbing pad (1000).

Figure 7A:
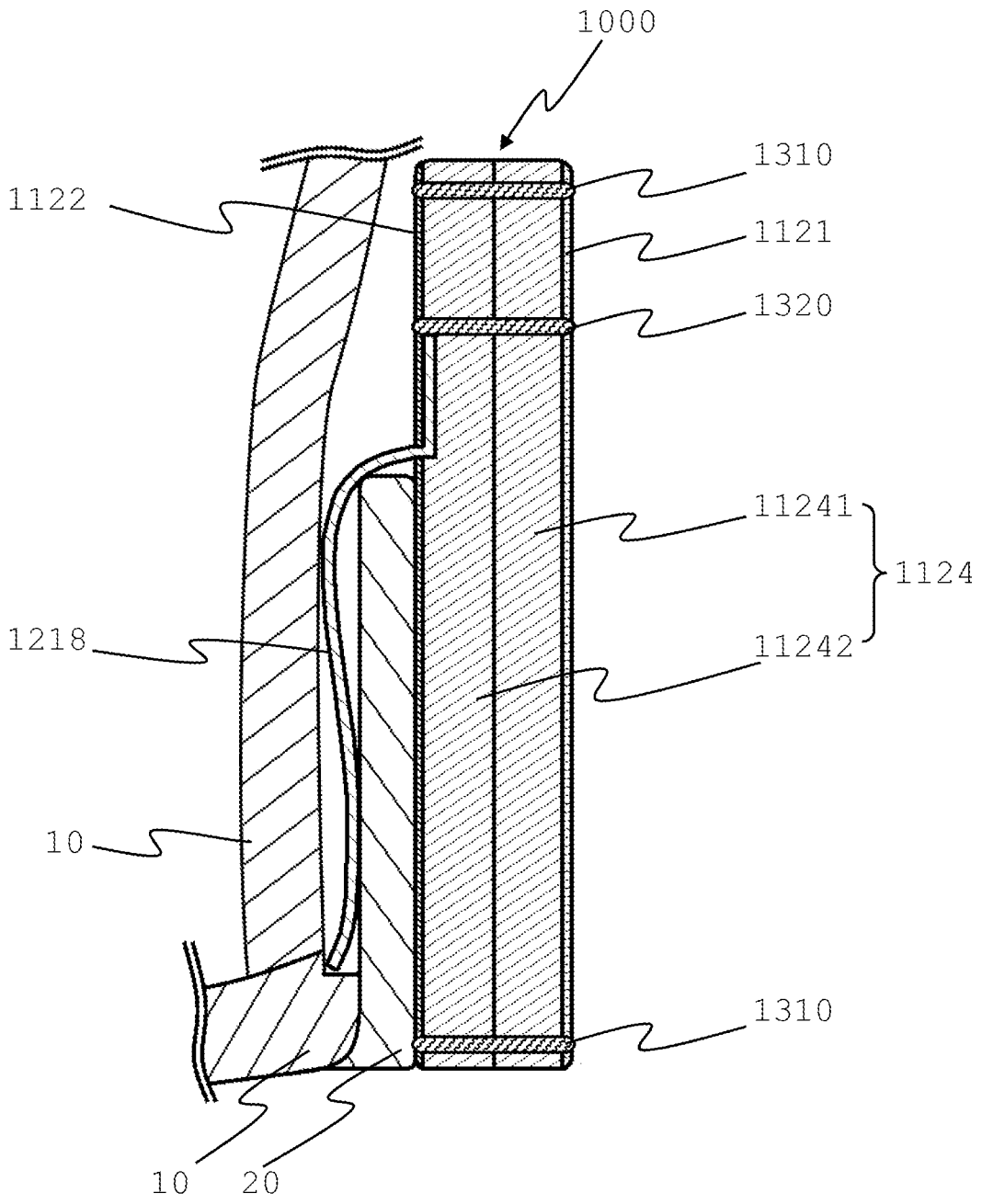
FIGS. 7A-B show partial cross-sectional views of sweat-absorbing pads from FIG. 1.
Figure 7B:
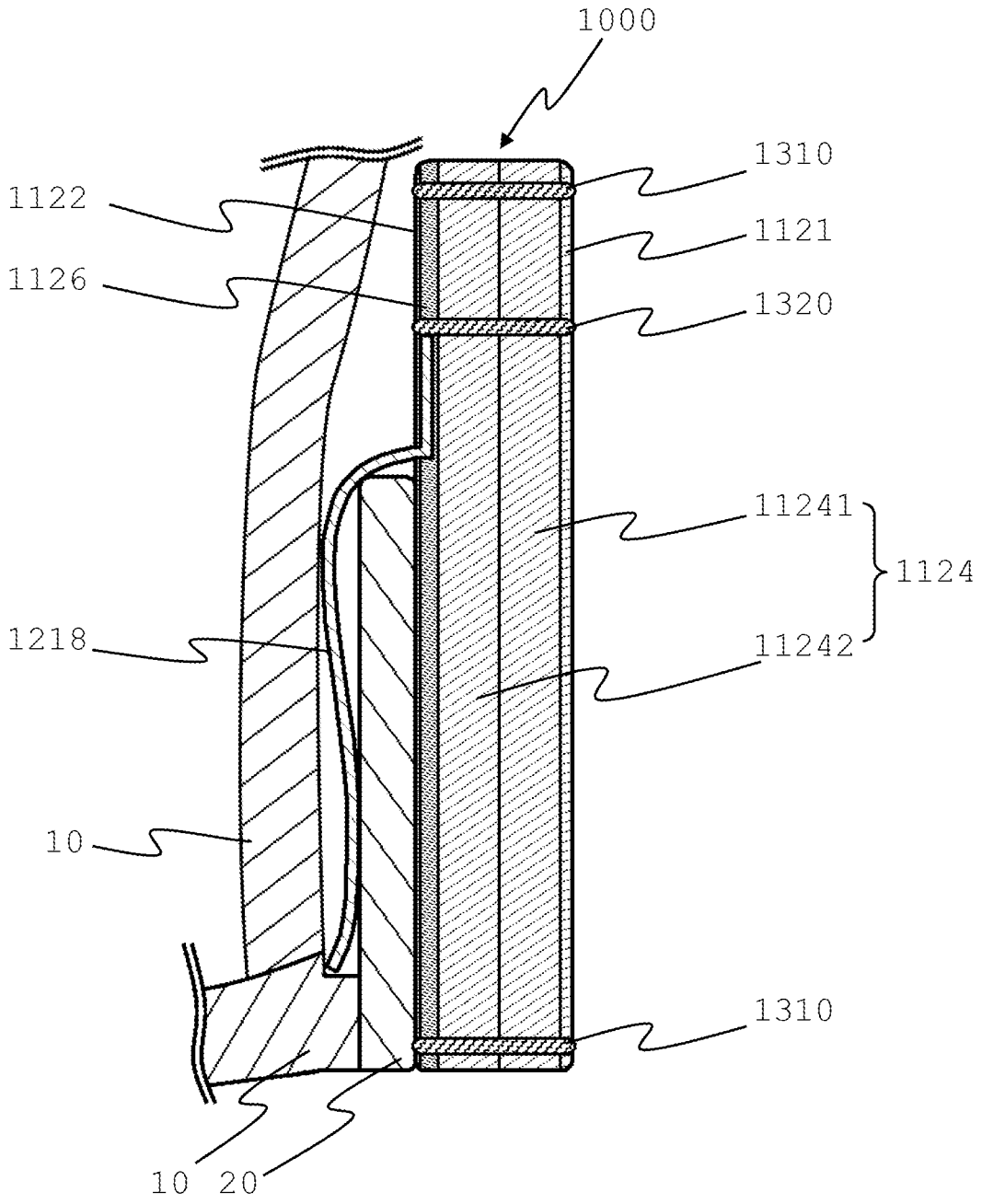

As shown in FIGS. 7A-B, a distance between a bottom edge of the clip arm (1218) and a bottom edge of the body (1100) is substantially the same as a width of a portion of the sweatband (20) where the sweatband (20) and headwear (10) are sewn together so that the bottom edge of the body (1100) substantially conforms to a bottom edge of the headwear (10) when the sweat-absorbing pad (1000) is detachably fixed to the sweatband (20) by the first clip (1201).

Also shown in FIG. 7A, the body (1100) of the sweat-absorbing pad (1000) includes a first outer layer (1121), an absorbent layer (1124) and a second outer layer (1122) with the second layer (1122) being the impervious layer. The first outer layer (1121) is preferably made from cotton and is configured to be in contact with the user's head or forehead such that sweat is initially transferred from the user's head or forehead and then travels to the absorbent layer (1124). The absorbent layer (1124) is constructed to absorb sweat that is received by the first outer layer (1121) from a user's head or forehead. The absorbent layer (1124) includes a first cotton layer (11241) and a second cotton layer (11242). The cotton used in first outer layer (1121) and the absorbent layer (1124) may be regular cotton or organic cotton. The second outer layer (1122) is constructed to block the sweat from passing through to the sweatband (20) or the headwear (10). The second layer (1122) may be made from any waterproof material such as (but not limited to) vinyl (pleather or plastic), polyurethane laminate, thermoplastic polyurethane, nylon taffeta, polyvinyl chloride (PVC)-coated polyester, laminated fabrics (cotton/poplin), coated microfiber, neoprene, other coated fabric material, and the like. Preferably, the second outer layer (1122) of the body (1100) is made from polyester. The clip body (1210) is substantially received in between the second outer layer (1122) and the absorbent layer (1124) with stitches (1320) substantially around the clip body (1210). Additionally, the first outer layer (1121), absorbent layer (1124), and the second outer layer (1122) are fixedly attached together with stitches (1310) around an edge of the body (1100). Alternatively, the absorbent layer (1124) may be a single layer or a plurality of layers made from sponge fabric, or a combination of polyester and nylon. Other fabrics that may be used for the absorbent layer (1124) include modal, micro-modal, viscose-based fibers, rayon, wool, bamboo fleece fabric, flax fibers, hemp fibers, minky, zorb, and the like. However, the absorbent layer (1124) has two or three layers preferably.

As shown in FIG. 7B, alternatively, the body (1100) of the sweat-absorbing pad (1000) includes an absorbent layer (1124) and an impervious layer (1126). The absorbent layer (1124) is constructed to absorb sweat from a user's head or forehead. The absorbent layer (1124) includes a first cotton layer (11241) and a second cotton layer (11242). The cotton used in first outer layer (1121) and the absorbent layer (1124) may be regular cotton or organic cotton. The impervious layer (1126) is constructed to block the sweat from passing through to the sweatband (20) or the headwear (10). The impervious layer (1126) may be made from any waterproof material such as (but not limited to) vinyl (pleather or plastic), polyurethane laminate, thermoplastic polyurethane, nylon taffeta, polyvinyl chloride (PVC)-coated polyester, laminated fabrics (cotton/poplin), coated microfiber, neoprene, other coated fabric material, and the like. Preferably, the impervious layer is made from polyester. Also as shown in FIG. 7B, the body (1100) may further include a first outer layer (1121) and a second outer layer (1122), where the first outer layer (1121) is made of cotton fabric (regular or organic cotton fabric) and configured to be in contact with the user's head or forehead such that sweat is initially transferred from the user's head or forehead and then travels to the absorbent layer (1124). The second outer layer (1122) of the body (1100) may be made from polyester. The clip body (1210) is substantially received in between the second outer layer (1122) and the impervious layer (1126) with stitches (1320) substantially around the clip body (1210). Additionally, the first outer layer (1121), the first cotton layer (11241), the second cotton layer (11242), the impervious layer (1126), and the second outer layer (1122) are fixedly attached together with stitches (1310) around an edge of the body (1100). Alternatively, the absorbent layer (1124) may be a single layer or a plurality of layers made from sponge fabric, or a combination of polyester and nylon. Other fabrics that may be used for the absorbent layer (1124) include modal, micro-modal, viscose-based fibers, rayon, wool, bamboo fleece fabric, flax fibers, hemp fibers, minky, zorb, and the like.

Figure 8A:
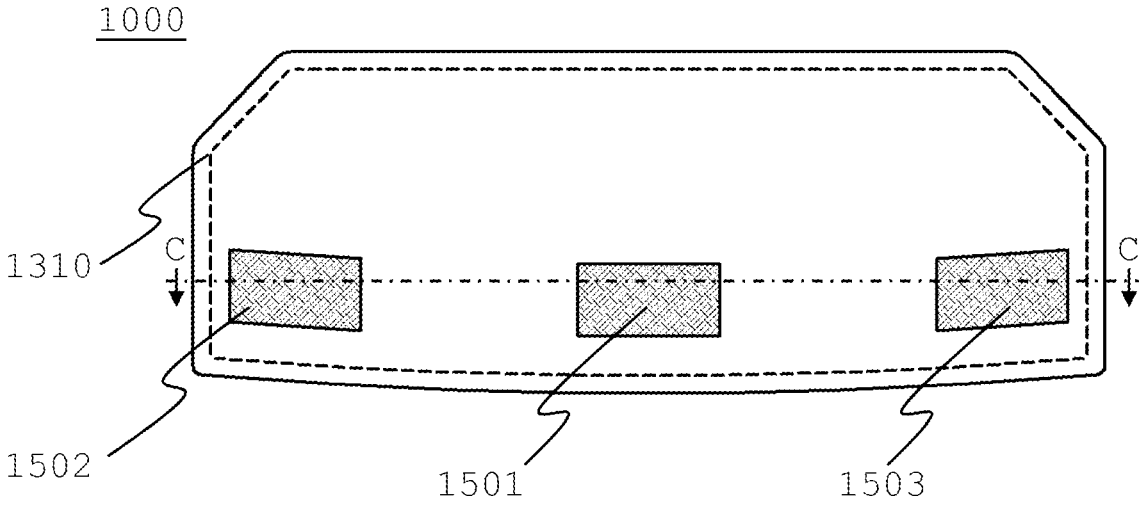
FIGS. 8A-D show views of a sweat-absorbing pad according to embodiments of the present invention with FIG. 8A showing a plan view of the sweat-absorbing pad, FIG. 8B showing a bottom perspective view of the invention without the sweat-absorbing pad, FIG. 8C showing a cross-sectional view as indicated in FIG. 8A, and FIG. 8D showing a partial cross-sectional view as indicated in FIG. 8B.
Figure 8B:
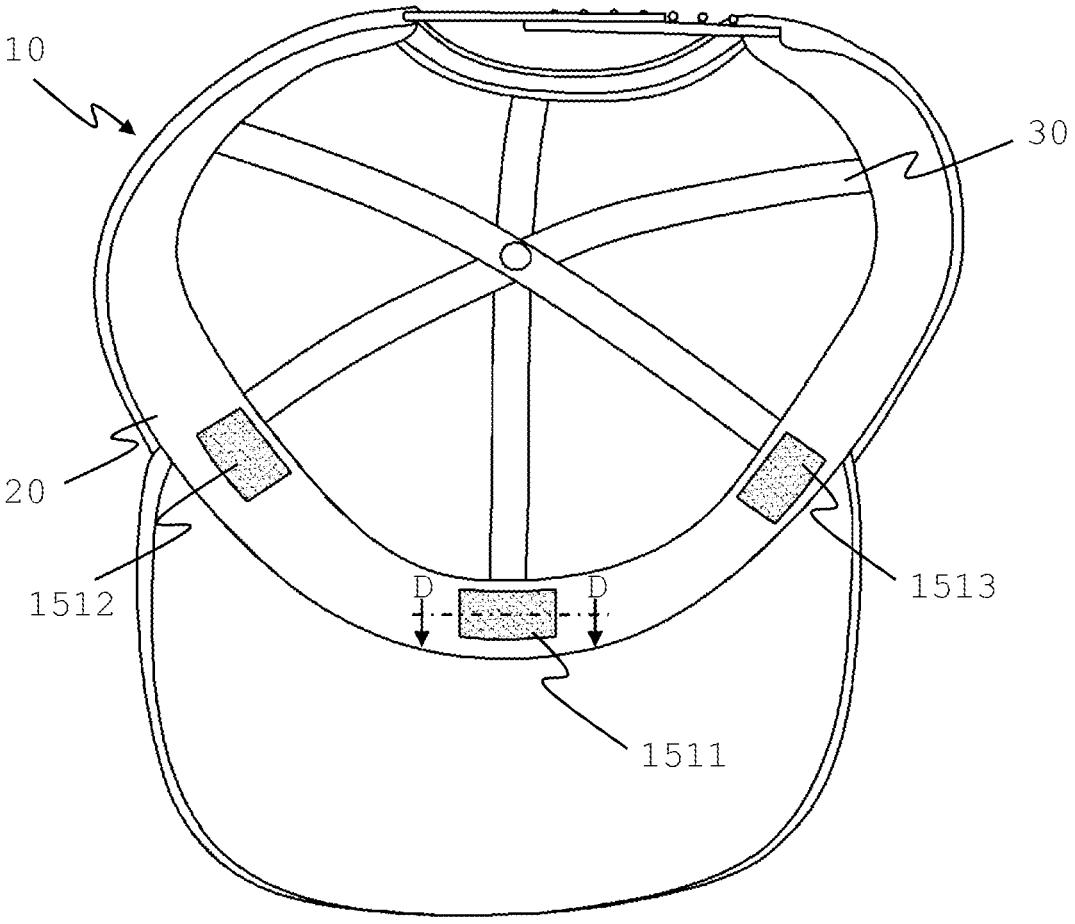
Figure 8C:
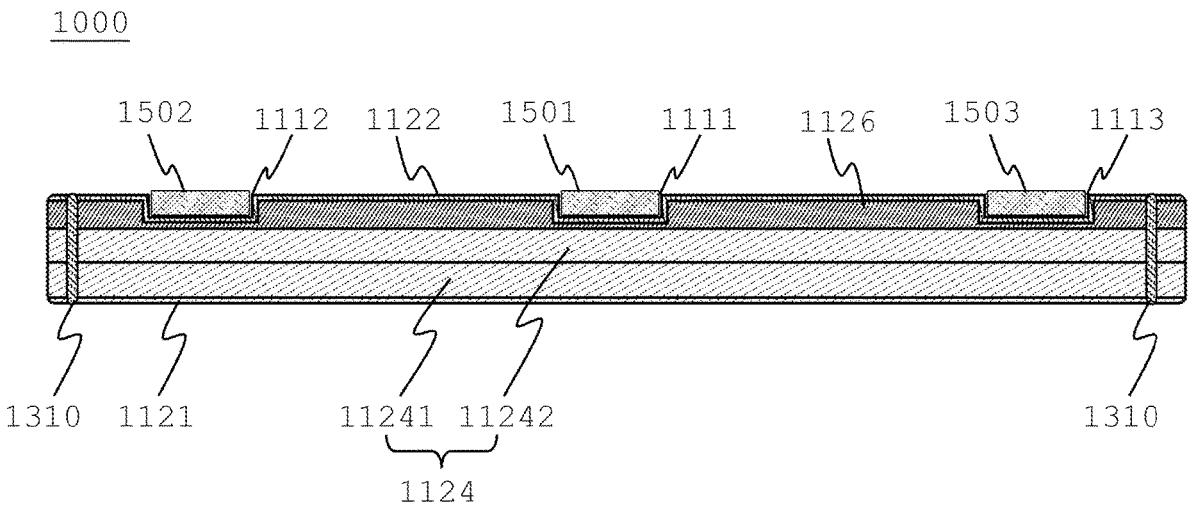
Figure 8D:
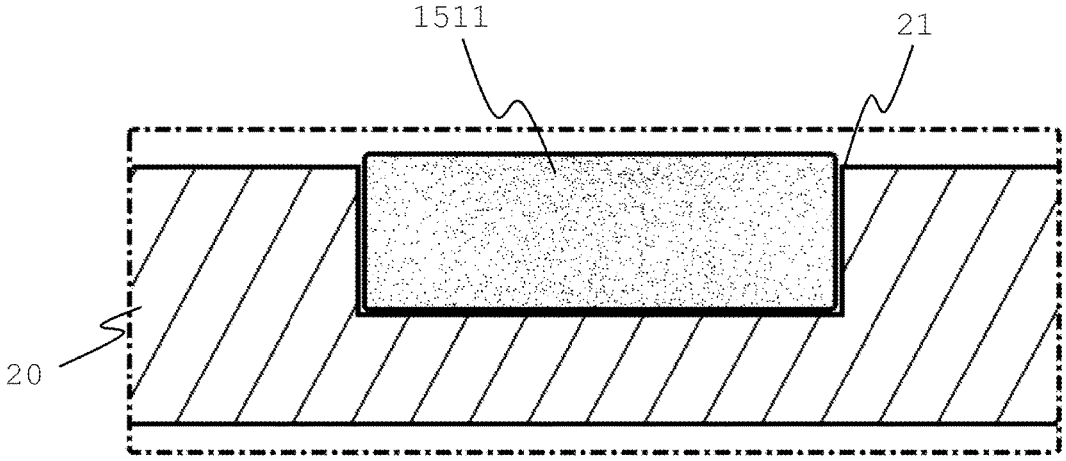

Alternatively, as shown in FIGS. 8A-B, a headwear (10) having a sweat-absorbing pad (1000), includes a sweat-absorbing pad (1000) having a first recess (1111), shown in FIG. 8C, wherein a first hook-and-loop fastener (1501) is received in the first recess (1111) of the sweat-absorbing pad (1000) and attached to the sweat-absorbing pad (1000); and a sweatband (20) having a first coupling recess (21) wherein a first coupling hook-and-loop fastener (1511) is received in the first coupling recess (21) of the sweatband (20) and sewn or attached to the sweatband (20). A shown, the first hook-and-loop fastener (1501) is configured to be detachably fastened to the first coupling hook-and-loop fastener (1511). As shown in FIGS. 8C-D, the first recess (1111) and the first coupling recess (21) may be holes formed in the sweat-absorbing pad (1000) and the sweatband (20) respectively that are constructed to receive and fix therein the first hook-and-loop fastener (1501) and the first coupling hook-and-loop fastener (1511). The coupling or fastening aspects of the first hook-and-loop fastener (1501) and the first coupling hook-and-loop fastener (1511) are presented about the surfaces of the sweat-absorbing pad (1000) and the sweatband (20) respectively such that the first hook-and-loop fastener (1501) and the first coupling hook-and-loop fastener (1511) detachably couple/fasten to each other, thus detachably fastening the sweat-absorbing pad (1000) to the sweatband (20), and vice versa. Alternatively, the first recess (1111) and the first coupling recess (21) may be depressions in the sweat-absorbing pad (1000) and the sweatband (20) constructed to accommodate and fix respectively the first hook-and-loop fastener (1501) and the first coupling hook-and-loop fastener (1511) therein to accomplish the detachable fastening between sweat-absorbing pad (1000) and the sweatband (20) as described above.

As shown in FIG. 8C, the sweat-absorbing pad (1000) having the first recess (1111) further includes a second recess (1112) and third recess (1113). A second hook-and-loop fastener (1502) is received in the second recess (1112) of the sweat-absorbing pad (1000) and attached to the sweat-absorbing pad (1000). A third hook-and-loop fastener (1503) is received in the third recess (1113) of the sweat-absorbing pad (1000) and attached to the sweat-absorbing pad (1000). The sweatband (20) has a second coupling recess (22) and a third coupling recess (23). A second coupling hook-and-loop fastener (1512) is received in the second coupling recess (22) of the sweatband (20) and sewn or attached to the sweatband (20). A third coupling hook-and-loop fastener (1513) is received in the third coupling recess (23) of the sweatband (20) and sewn or attached to the sweatband (20). The second and third recesses (1112, 1113) of the sweat-absorbing pad (1000) are similar to the first recess (1111) described above and the second and third coupling recesses (22, 23) of the sweatband (20) are similar to the first coupling recess (21) described above.

The first hook-and-loop fastener (1501) is configured to be detachably fastened to the first coupling hook-and-loop fastener (1511). The second hook-and-loop fastener (1502) is configured to be detachably fastened to the second coupling hook-and-loop fastener (1512). The third hook-and-loop fastener (1503) is configured to be detachably fastened to the third coupling hook-and-loop fastener (1513).

As mentioned above and shown in FIG. 7B, the body (1100) of the sweat-absorbing pad (1000) having the first recess (1111) includes an absorbent layer (1124) and an impervious layer (1126). The absorbent layer (1124) is configured to absorb sweat from a user's head or forehead. The impervious layer (1126) is configured to block the sweat from passing through to the sweatband (20) or the headwear (10). The absorbent layer (1124) includes a first cotton layer (11241) and a second cotton layer (11242). The cotton used in first outer layer (1121) and the absorbent layer (1124) may be regular cotton or organic cotton. The impervious layer (1126) is configured to block the sweat from passing through to the sweatband (20) or the headwear (10). The impervious layer (1126) may be made from any waterproof material such as (but not limited to) vinyl (pleather or plastic), polyurethane laminate, thermoplastic polyurethane, nylon taffeta, polyvinyl chloride (PVC)-coated polyester, laminated fabrics (cotton/poplin), coated microfiber, neoprene, other coated fabric material, and the like. As shown, the body (1100) may further include a first outer layer (1121) and a second outer layer (1122), where the first outer layer (1121) is made of cotton fabric (regular or organic cotton fabric) and intended to be in contact with the user's head or forehead such that sweat is initially transferred from the user's head or forehead and then travels to the absorbent layer (1124). The second outer layer (1122) of the body (1100) may be made from polyester. The clip body (1210) is substantially received in between the second outer layer (1122) and the impervious layer (1126) with stitches (1320) substantially around the clip body (1210). Additionally, the first outer layer (1121), the first cotton layer (11241), the second cotton layer (11242), the impervious layer (1126), and the second outer layer (1122) are fixedly attached together with stitches (1310) around an edge of the body (1100). Alternatively, the absorbent layer (1124) may be a single layer or a plurality of layers made from sponge fabric, or a combination of polyester and nylon. Other fabrics that may be used for the absorbent layer (1124) include modal, micro-modal, viscose-based fibers, rayon, wool, bamboo fleece fabric, flax fibers, hemp fibers, minky, zorb, and the like.

A sweat-absorbing pad (1000) for use with a headwear (10) having a sweatband (20), the sweat-absorbing pad (1000) including a body (1100) which includes an absorbent layer (1124) and an impervious layer (1126); and an attachment means configured such that the sweat-absorbing pad (1000) is detachably fixed to the sweatband (20). As mentioned above, the absorbent layer (1124) is configured to absorb sweat from a user's head or forehead, and the impervious layer (1126) is configured to block the sweat from passing through to the sweatband (20) or the headwear (10). The impervious layer (1126) may be made from any waterproof material such as (but not limited to) vinyl (pleather or plastic), polyurethane laminate, thermoplastic polyurethane, nylon taffeta, polyvinyl chloride (PVC)-coated polyester, laminated fabrics (cotton/poplin), coated microfiber, neoprene, other coated fabric material, and the like. As shown, the body (1100) may further include a first outer layer (1121) and a second outer layer (1122), where the first outer layer (1121) is made of cotton fabric and intended to be in contact with the user's head or forehead such that sweat is initially transferred from the user's head or forehead and then travels to the absorbent layer (1124). The second outer layer (1122) of the body (1100) may be made from polyester. The clip body (1210) is substantially received in between the second outer layer (1122) and the impervious layer (1126) with stitches (1320) substantially around the clip body (1210). Additionally, the first outer layer (1121), the first cotton layer (11241), the second cotton layer (11242), the impervious layer (1126), and the second outer layer (1122) are fixedly attached together with stitches (1310) around an edge of the body (1100). Alternatively, the absorbent layer (1124) may be a single layer or a plurality of layers made from sponge fabric, or a combination of polyester and nylon. Other fabrics that may be used for the absorbent layer (1124) include modal, micro-modal, viscose-based fibers, rayon, wool, bamboo fleece fabric, flax fibers, hemp fibers, minky, zorb, and the like.

Figure 9A:
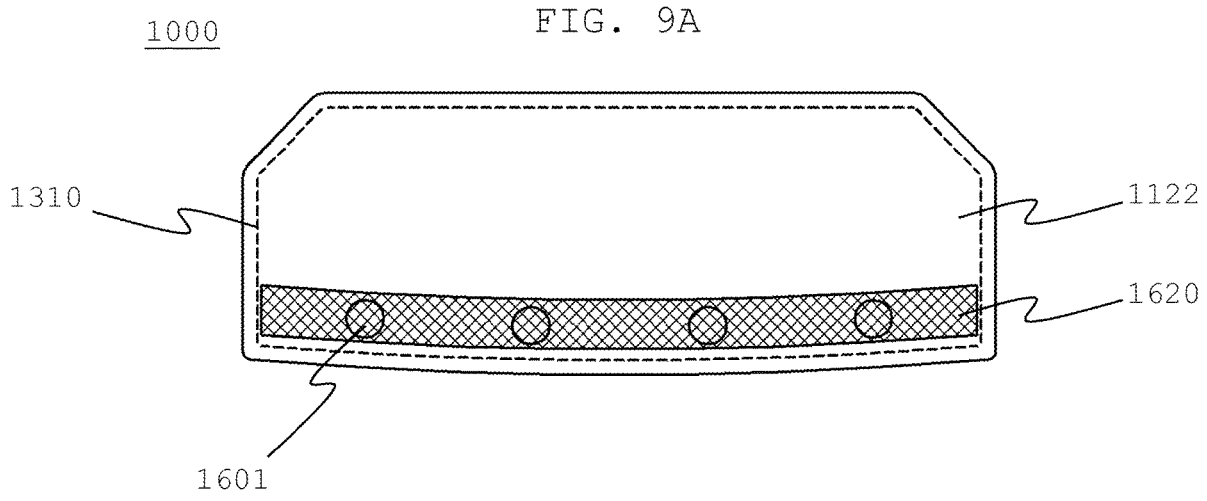
FIGS. 9A-B show views of a sweat-absorbing pad according to embodiments of the present invention with FIG. 9A showing a plan view of the sweat-absorbing pad and FIG. 9B showing a bottom perspective view without the sweat-absorbing pad.

As shown in FIG. 9A, the attachment means of the sweat-absorbing pad (1000) may include one or more magnets (1601). To accommodate any magnet(s) (1601), the body (1100) includes one or more recesses, each of which receives at least the one or more magnets (1601) therein. The recess may be hole(s) formed in the body (1100) of sweat-absorbing pad (1000) as described above, the hole(s) constructed to receive and fix therein the one or more magnet (1601). Alternatively, the recess may be depression(s) in the body (1100) of the sweat-absorbing pad (1000), the depression(s) constructed to accommodate and fix therein the magnet(s). The magnet(s) (1601) may be further secured to the body (1100) by a mesh (1620) that overlays a face of the magnet(s) (1601) that is directed towards the sweatband (20) of the headwear (10).

Figure 9B:
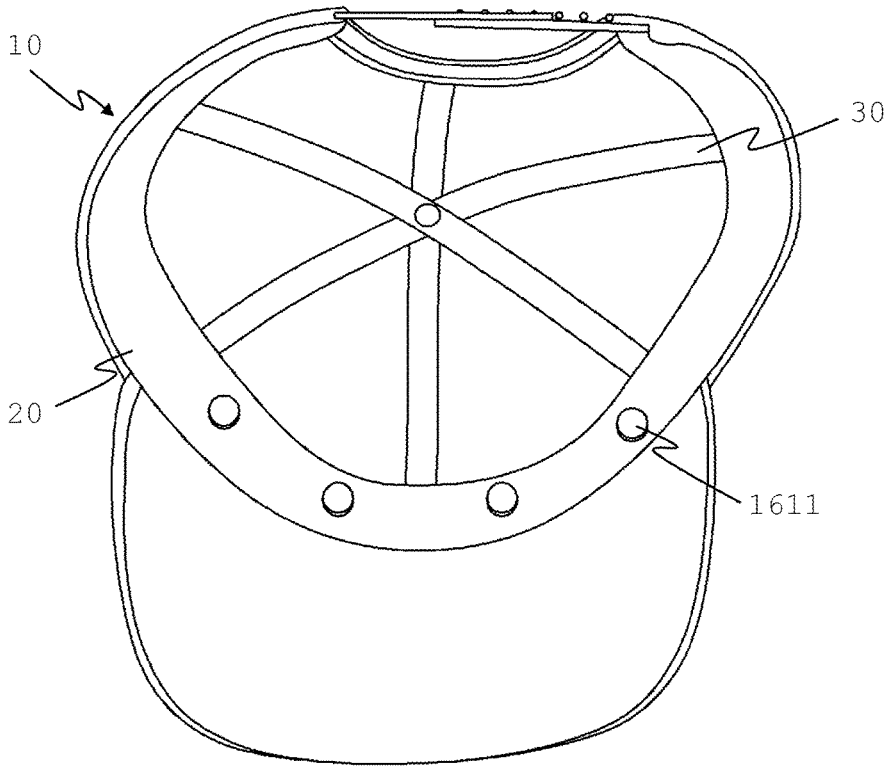

As shown in FIG. 9B, the sweatband (20) includes one or more ferromagnetic members (1611) such that each of the one or more ferromagnetic members (1611) is configured to magnetically couple to each of the one or more magnets (1601). The recess may be a depression or a hole constructed to receive at least one magnet therein (1601); the depression or the hole may include an adhesive to hold onto the magnet located therein. Preferably, as shown in FIGS. 9A-B, the number of magnets (1601) is four, the number of recesses is four, and the number of ferromagnetic members (1611) is four. The four magnets (1601) are aligned such that they are not positioned on any of the interior taping (30) of the headwear (10). The mesh (1620) is constructed to be porous enough such that there is little to no interruption of the magnetic attraction between the magnet(s) (1601) and the ferromagnetic magnet member(s) (1611).

Figure 10:
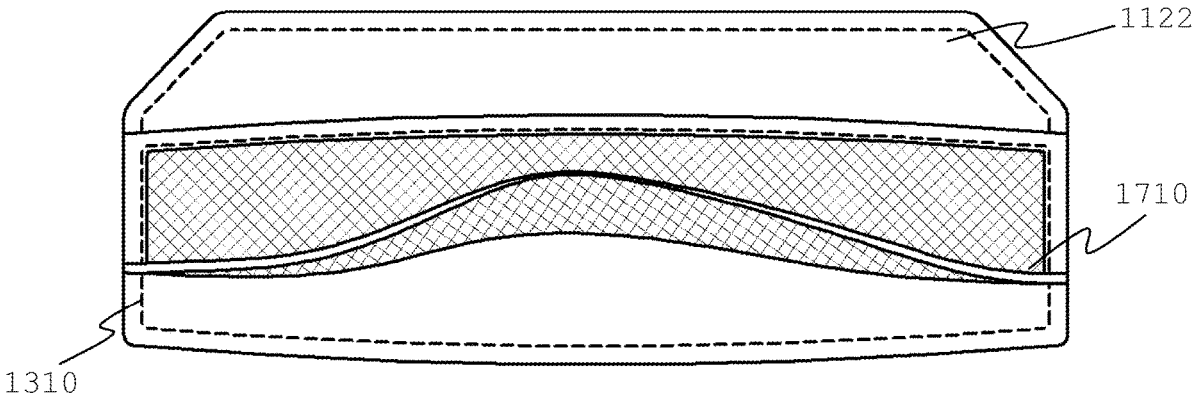
FIG. 10 shows a perspective view a sweat-absorbing pad according to embodiments of the present invention.

Alternatively, as shown in FIG. 10, the attachment means may include a mesh insert (1710), where a top edge of the mesh insert is sewn to the body (1100) and a bottom edge of the mesh insert (1710) is configured to be received between an inner surface of the headwear (10) and the sweatband (20).

Figure 11A:
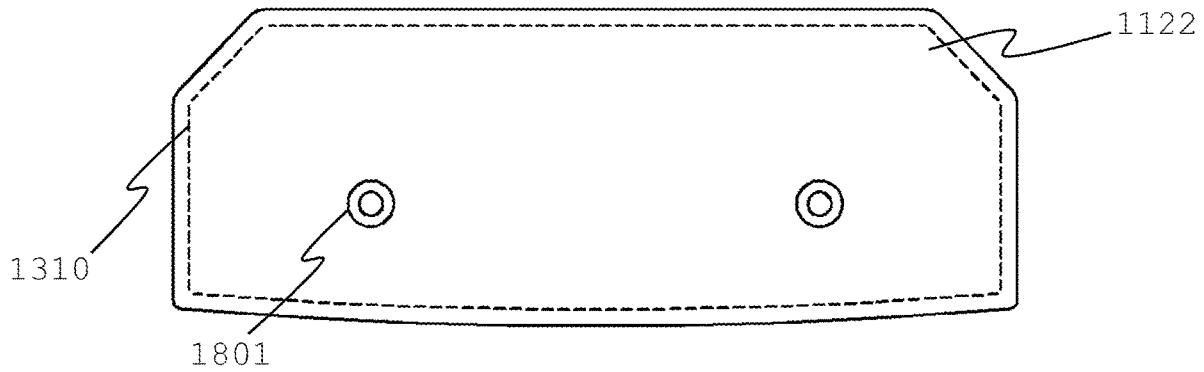
FIGS. 11A-B show views of a sweat-absorbing pad according to embodiments of the present invention with FIG. 11A showing a plan view of the sweat-absorbing pad and FIG. 11B showing a bottom perspective view without the sweat-absorbing pad.
Figure 11B:
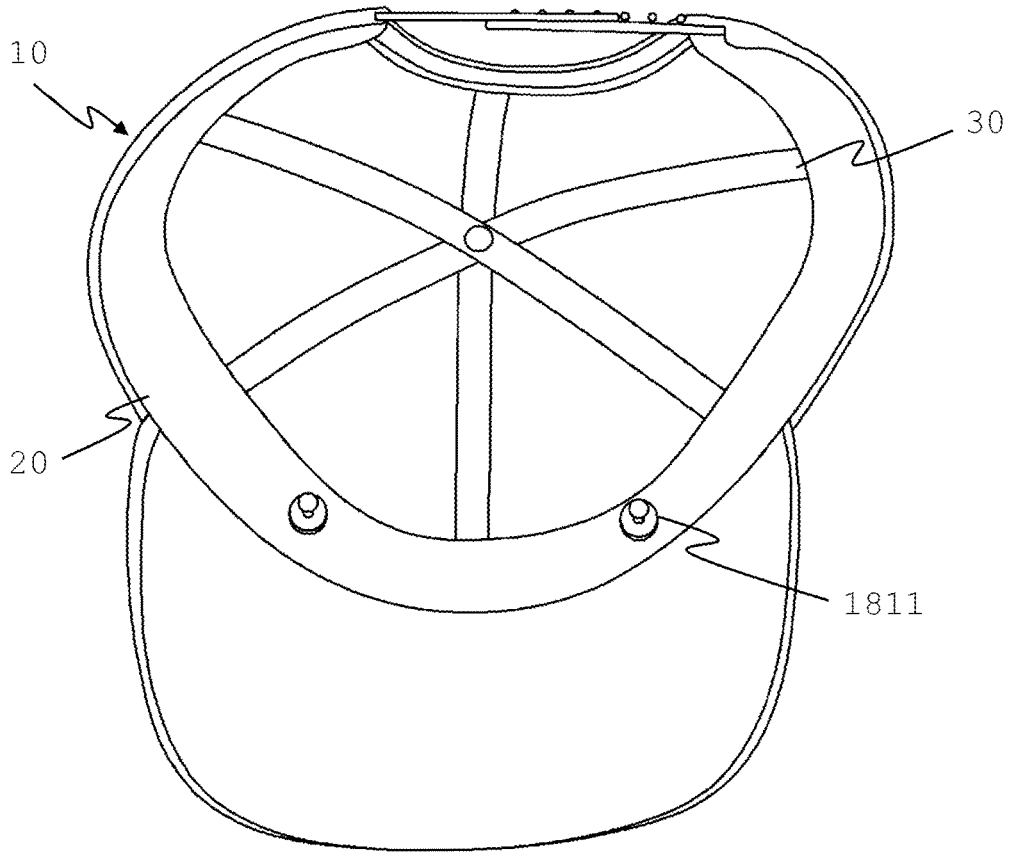

Alternatively, as shown in FIGS. 11A-B, the attachment means includes either member of a snap fastener defined by a matching pair of stud and socket parts (1811, 1801). The stud part (1801) is fixed to the sweatband (20) and the socket part (1811) is fixed to the body (1100) as shown in FIGS. 11A-B, or the stud part (1801) is fixed to the body (1100) and the socket part (1811) is fixed to the sweatband (20) (not shown). Furthermore, the stud part (1801) is configured to be fastened to the socket part (1811). The snap fasteners (1811, 1801) are aligned such that they are not positioned on any of the interior taping (30) of the headwear (10) as shown in FIGS. 11A-B.

While the invention has been shown and described with reference to different embodiments thereof, it will be appreciated by those skilled in the art that variations in form, detail, compositions and operation may be made without departing from the spirit and scope of the invention as defined by accompanying claims.

What is claimed is:

1. A sweat-absorbing pad for use with a headwear having a sweatband, comprising:

a body wherein a front surface thereof is configured to contact, at least in part, a user's head or forehead for absorbing sweat; and a first clip comprising:

a clip body which includes a base, a first leg and a second leg wherein the first and second legs extend from the base; and a clip arm which extends from the base wherein the clip arm is substantially parallel to the first and second legs, wherein the clip arm is resilient to bias against the clip body, wherein the clip body is substantially received in the body, wherein the first clip is configured to receive at least a portion of the sweatband that fits in between the body and the clip arm in order for the sweat-absorbing pad to be detachably fixed to the sweatband, wherein the clip arm is positioned between the first leg and the second leg, wherein the first leg and the second leg extend from both ends of the base and the clip arm extends from about a middle of the base, wherein the clip arm extends beyond the first leg and the second leg, wherein the clip arm bends upwardly from the first and second legs and then downwardly toward the first and second legs, and wherein an end of the clip arm bends upwardly from the first and second legs for easy insertion of the sweatband in between the clip arm and the body.

2. The sweat-absorbing pad of claim 1, wherein the clip body is substantially received in the body with stitches substantially around the clip body, and wherein a slit is formed on the body such that the clip arm extends from the clip body out of the slit.

3. The sweat-absorbing pad of claim 1, wherein a distance between a bottom edge of the clip arm and a bottom edge of the body is substantially the same as a width of a portion of the sweatband where the sweatband and headwear are sewn together so that the bottom edge of the body substantially conforms to a bottom edge of the headwear when the sweat-absorbing pad is detachably fixed to the sweatband by the first clip.

4. The sweat-absorbing pad of claim 1, further comprising a second clip wherein the second clip has a structure substantially the same as a structure of the first clip, wherein the body is symmetrical with respect to a middle line, and wherein the first clip and the second clip are symmetrically positioned with respect to the middle line.

5. The sweat-absorbing pad of claim 4, further comprising a third clip wherein the third clip has a structure substantially the same as the structure of the first clip, wherein the third clip is substantially positioned in the middle line.

6. The sweat-absorbing pad of claim 1, wherein the body comprises a first outer layer, an absorbent layer, and a second outer layer, and wherein the second outer layer is an impervious layer, and wherein the first outer layer is intended to be in contact with the user's head or forehead.

7. The sweat-absorbing pad of claim 6, wherein the first outer layer is made of cotton, wherein the absorbent layer comprises at least one cotton layer, wherein the impervious layer is made of polyester, wherein the clip body is substantially received in between the second outer layer and the absorbent layer with stitches substantially around the clip body.

8. The sweat-absorbing pad of claim 6, wherein the absorbent layer is made of spongy fabric, or a combination of polyester and nylon.

9. The sweat-absorbing pad of claim 1, wherein the body comprises a first outer layer, a second outer layer, an absorbent layer, and an impervious layer, wherein the absorbent layer is constructed to absorb sweat from a user's head or forehead, wherein the impervious layer is constructed to block the sweat from passing through to the sweatband or the headwear, and wherein the first outer layer is intended to be in contact with the user's head or forehead.

10. The sweat-absorbing pad of claim 9, wherein the absorbent layer is made of cotton, wherein the impervious layer is made of polyester, wherein the clip body is substantially received in between the second outer layer and the impervious layer with stitches substantially around the clip body.

11. A sweat-absorbing pad for use with a headwear having a sweatband, comprising:

a body wherein a front surface thereof is configured to contact, at least in part, a user's head or forehead for absorbing sweat; and a first clip comprising:

a clip body which includes a base, a first leg and a second leg wherein the first and second legs extend from the base; and a clip arm which extends from the base wherein the clip arm is substantially parallel to the first and second legs, wherein the clip arm is resilient to bias against the clip body, wherein the clip body is substantially received in the body, wherein the first clip is configured to receive at least a portion of the sweatband that fits in between the body and the clip arm in order for the sweat-absorbing pad to be detachably fixed to the sweatband, wherein the clip arm is positioned between the first leg and the second leg, wherein the first leg and the second leg extend from both ends of the base and the clip arm extends from about a middle of the base, wherein the clip arm extends beyond the first leg and the second leg, wherein the clip body is substantially received in the body with stitches substantially around the clip body, and wherein a slit is formed on the body such that the clip arm extends from the clip body out of the slit.

12. The sweat-absorbing pad of claim 11, wherein a distance between a bottom edge of the clip arm and a bottom edge of the body is substantially the same as a width of a portion of the sweatband where the sweatband and headwear are sewn together so that the bottom edge of the body substantially conforms to a bottom edge of the headwear when the sweat-absorbing pad is detachably fixed to the sweatband by the first clip.

13. The sweat-absorbing pad of claim 12, further comprising a second clip wherein the second clip has a structure substantially the same as a structure of the first clip, wherein the body is symmetrical with respect to a middle line, and wherein the first clip and the second clip are symmetrically positioned with respect to the middle line.

14. The sweat-absorbing pad of claim 13, further comprising a third clip wherein the third clip has a structure substantially the same as the structure of the first clip, wherein the third clip is substantially positioned in the middle line.

15. The sweat-absorbing pad of claim 11, wherein the body comprises a first outer layer, an absorbent layer, and a second outer layer, and wherein the second outer layer is an impervious layer, and wherein the first outer layer is intended to be in contact with the user's head or forehead.

16. The sweat-absorbing pad of claim 15, wherein the first outer layer is made of cotton, wherein the absorbent layer comprises at least one cotton layer, wherein the impervious layer is made of polyester, wherein the clip body is substantially received in between the second outer layer and the absorbent layer with stitches substantially around the clip body.

17. The sweat-absorbing pad of claim 11, wherein the body comprises a first outer layer, a second outer layer, an absorbent layer, and an impervious layer, wherein the absorbent layer is constructed to absorb sweat from a user's head or forehead, wherein the impervious layer is constructed to block the sweat from passing through to the sweatband or the headwear, and wherein the first outer layer is intended to be in contact with the user's head or forehead.

18. The sweat-absorbing pad of claim 17, wherein the absorbent layer is made of cotton, wherein the impervious layer is made of polyester, wherein the clip body is substantially received in between the second outer layer and the impervious layer with stitches substantially around the clip body.

19. A sweat-absorbing pad for use with a headwear having a sweatband, comprising:

a body wherein a front surface thereof is configured to contact, at least in part, a user's head or forehead for absorbing sweat; and a first clip comprising:

a clip body which includes a base, a first leg and a second leg wherein the first and second legs extend from the base; and a clip arm which extends from the base wherein the clip arm is substantially parallel to the first and second legs, wherein the clip arm is resilient to bias against the clip body, wherein the clip body is substantially received in the body, wherein the first clip is configured to receive at least a portion of the sweatband that fits in between the body and the clip arm in order for the sweat-absorbing pad to be detachably fixed to the sweatband, wherein the body comprises a first outer layer, an absorbent layer, and a second outer layer, wherein the second outer layer is an impervious layer, and wherein the first outer layer is intended to be in contact with the user's head or forehead, wherein the first outer layer is made of cotton, wherein the absorbent layer comprises at least one cotton layer, wherein the impervious layer is made of polyester, wherein the clip body is substantially received in between the second outer layer and the absorbent layer with stitches substantially around the clip body.

20. A sweat-absorbing pad for use with a headwear having a sweatband, comprising:

a body wherein a front surface thereof is configured to contact, at least in part, a user's head or forehead for absorbing sweat; and a first clip comprising:

a clip body which includes a base, a first leg and a second leg wherein the first and second legs extend from the base; and a clip arm which extends from the base wherein the clip arm is substantially parallel to the first and second legs, wherein the clip arm is resilient to bias against the clip body, wherein the clip body is substantially received in the body, wherein the first clip is configured to receive at least a portion of the sweatband that fits in between the body and the clip arm in order for the sweat-absorbing pad to be detachably fixed to the sweatband, wherein the body comprises a first outer layer, a second outer layer, an absorbent layer, and an impervious layer, wherein the absorbent layer is constructed to absorb sweat from a user's head or forehead, wherein the impervious layer is constructed to block the sweat from passing through to the sweatband or the headwear, wherein the first outer layer is intended to be in contact with the user's head or forehead, wherein the absorbent layer is made of cotton, wherein the impervious layer is made of polyester, wherein the clip body is substantially received in between the second outer layer and the impervious layer with stitches substantially around the clip body.

* * * * *